US005205404A

United States Patent [19]

Mickman et al.

[11] Patent Number: 5,205,404

[45] Date of Patent: Apr. 27, 1993

[54] DECORATIVE WREATH SHIPPING CONTAINER

[75] Inventors: Christopher R. Mickman, Anoka; John S. Mickman, Wyoming, both of Minn.

[73] Assignee: Mickman Bros. Nurseries, Inc., Anoka, Minn.

[21] Appl. No.: 947,624

[22] Filed: Sep. 21, 1992

[51] Int. Cl.[5] ..... B65D 85/02

[52] U.S. Cl. ..... 206/303; 206/423; 206/485; 206/583; 206/524.3; 206/811

[58] Field of Search ..... 47/84; 206/303, 423, 206/446, 485, 493, 521, 524.3, 583, 588-590, 811

[56] References Cited

U.S. PATENT DOCUMENTS

| | | | |
|---|---|---|---|
| 2,639,807 | 5/1953 | Ambrette et al. | 206/446 |
| 3,280,987 | 10/1966 | Steinbock | 206/303 |
| 3,298,592 | 1/1967 | Hurley | 206/303 |
| 3,572,574 | 3/1971 | Mears | 206/588 |
| 3,768,641 | 10/1973 | Jerzewski, Jr. | 206/303 |
| 4,140,218 | 2/1979 | Forte | 206/303 |

FOREIGN PATENT DOCUMENTS

| | | | |
|---|---|---|---|
| 0392373 | 9/1965 | Switzerland | 206/303 |
| 0013224 | of 1915 | United Kingdom | 206/303 |

*Primary Examiner*—Jimmy G. Foster
*Attorney, Agent, or Firm*—Haugen and Nikolai

[57] ABSTRACT

A shipping container for decorative wreaths comprising a box having two ends and four sides with three inserts each having a base and four side walls installed in the box. The base of each insert has a tube hole formed through it and an elongated tube extends through the tube holes perpendicular to the bases from one end of the box to the other. The wreaths and inserts slide onto the elongated tube through the ends of the box. To prevent moisture given off by the wreaths from condensing and rotting the wreaths and from being absorbed by the cardboard of the container, ventilation holes are cut into the box and inserts. Ventilation holes in the ends of the box are also used for carrying the container. To further prevent the cardboard from absorbing moisture, one side of the box and each insert is treated with a moisture barrier and a curtain coating is applied to the middle strip of the inserts.

21 Claims, 3 Drawing Sheets

DECORATIVE WREATH SHIPPING CONTAINER

BACKGROUND OF THE INVENTION

I. Field of the Invention

This invention relates generally to shipping containers and more particularly to a shipping container for decorative wreaths.

II. Discussion of the Prior Art

Decorative wreaths are made from pine boughs and fir boughs fastened to a metal hoop to form a circular toroidal shape. The wreaths include flowers, ribbons, bells, cones and other decorations to add life and color. In the past, the decorative wreaths have been stored and shipped in ordinary cardboard boxes. This method of storing and shipping wreaths has presented a number of problems. Ordinary cardboard boxes tend to collapse, allowing the wreaths to be crushed before arriving at their destination. Moisture given off by the wreaths is absorbed by the cardboard, thereby weakening the box. Stacking wreaths on top of each other will also crush the underlying wreaths, making them unattractive. The problems of collapsing boxes and crushed wreaths prompted research and design efforts in the area of a new shipping package for decorative wreaths.

First efforts in designing a new carton for shipping and storing wreaths included adding dividers or inserts and a wax curtain coating to improve the strength of the carton. The inserts helped with the problem of crushed boxes, but they did not help with the problem of the wreaths being crushed by their own weight. Curtain coating the interior of the boxes improved the strength of the box by preventing impregnation of moisture into the cardboard. However, the curtain coating also held almost all of the moisture given off by the wreaths inside the box. This moisture condensed on the interior surface, ran down the sides and puddled on the bottom. The water created an environment conducive to growing mold, resulting in rotted wreaths.

Current container designs do not individually or as a whole overcome the problems of crushed boxes or crushed and moldy or rotted wreaths. For example, U.S. Pat. No. 3,768,641, issued to Jerzewski, Jr., discloses a container for packaging a plurality of tape rolls. The container has two ends and walls therebetween and is provided with two inserts which form at least one sturdy, adjustable beam for supporting the tape rolls away from the walls of the container. Each insert comprises a planar base for fitting in close contact with an end of the container and an elongated projection extending into the container from a central portion of the base. When the two inserts are fitted against the opposed ends of the container, the elongated projections overlie each other and form the supporting beam. The inserts of the '641 patent add support to the ends of the box, not to the middle of the box. The middle of the box is susceptible to being crushed by the weight of other boxes or objects stacked on it. The box described in the '641 patent also does not have any holes in the ends or the sides to allow moisture to escape. Further, the inserts do not have any holes designed for ventilating the container. Thus, if decorative wreaths were shipped in a container similar to the one disclosed in the '641 patent, the moisture from the wreaths would condense in the container and penetrate the cardboard causing it to become weak. The moisture would also create an environment conducive to growing mold, resulting in rotten wreaths.

In contrast to the box disclosed in the '641 patent, the present invention uses three inserts, one on each end and one in the middle to support the box. The additional insert adds support to the middle of the box so the box will not be crushed. The wreath shipping box of the present invention has a treated interior. The interior walls and inserts are provided with a moisture barrier or wax curtain coating to prevent absorption of moisture by the cardboard. A number of ventilation holes are formed in the box and in the inserts to provide adequate ventilation to the wreaths during shipping and storage.

U.S. Pat. No. 3,280,987, issued to Steinbock, discloses a container that uses a spindle for stacking rolls and spools of tape. The container and spindle arrangement disclosed in the '987 patent show the rolls stacked one on top of another. If its teachings were followed and applied to wreaths, this arrangement would result in crushing of the wreaths. Further, the '987 patent does not disclose the concept of using a third insert to support the box or the use of ventilation holes in the box or the inserts. Thus, the '987 patent does not teach or suggest a solution to the problems of crushed boxes and wreaths or condensation of moisture.

U.S. Pat. Nos. 4,079,835, issued to Kendig, and U.S. Pat. No. 2,642,183, issued to Prossen, disclose containers for shipping or storing articles such as rolls of flexible sheet or film material or rolls of yarn. The containers disclosed in these patents do not disclose using a horizontal tube to hang wreaths on or boxes and inserts with ventilation holes in them designed to allow the container and the articles inside the container to breathe.

From the above analysis, it can be seen that the prior art references of which we are aware, individually and as a whole, do not disclose a decorative wreath shipping container having 1) a third insert for structural support, 2) a horizontal tube for suspending the wreaths so they are not crushed by their own weight nor 3) ventilation holes in the boxes and inserts to prevent moisture from impregnating the cardboard and weakening the structural integrity of the container and to prevent moisture from creating an environment conducive to growing mold that results in rotted wreaths.

SUMMARY OF THE INVENTION

The present invention is directed to a decorative wreath shipping container that uses treated cardboard inserts for structurally supporting the outer carton, a horizontal tube extending through the inserts for suspending the wreaths, ventilation holes in the boxes and inserts to allow the container and articles in the container to breathe and treated interior walls of the carton to inhibit moisture absorption. Thus, the problems of crushed boxes, crushed wreaths and moldy or rotten wreaths are overcome by the present invention.

It is accordingly a principal object of the invention to provide an improved shipping container for decorative wreaths.

Another object of the invention is to provide an improved shipping container that will not be crushed when other cartons or objects are stacked on it.

Yet another object of the invention is to provide an improved decorative wreath shipping container that can store or transport wreaths hanging from an inner horizontal support so that the wreaths do not get crushed, moldy or rotten.

The foregoing features and advantages of the present invention are attained by providing a shipping container having a box with two ends and four sides. Identical inserts having a base and four sides snugly fit inside the box so that the planes of the bases are parallel to the planes of the two ends of the box. An elongated tube extends through the inserts from one end of the box to the other. Preferably, three inserts are used to add structural support to the box; one insert at each end of the box and a third insert approximately midway between the two ends of the box. The planar base of each insert has a tube hole toward the top and centered with respect to the width dimension. The elongated tube slidably extends through the tube hole of each insert, perpendicular to the plane of the insert base from one end of the box to the other. With this insert and elongated tube arrangement, a plurality of inserts can be used at any desired spacing to add support to the box.

In the preferred embodiment, the box, inserts, and elongated tube are made out of corrugated cardboard. To prevent moisture given off by the wreaths from being absorbed by the cardboard, ventilation holes are situated at both ends of the box and on two of the opposing sides. Each end of the box has one oblong hole used for both ventilating the container and as a handle. The opposing sides each have two circular holes, one side having the holes toward the top and the other side having the holes toward the bottom, to facilitate a flow of air through the wreaths from one side to the other. The inserts are also provided with ventilation holes which allow air to flow from one end of the box to the other. Each insert has two oblong holes above the tube hole and two circular holes below the tube hole, one on each side of the tube hole. The ventilation holes are small enough so the strength of the box and inserts is not compromised, but large enough to allow the container to breathe and the moisture inside the container to be carried out.

The box's sides and end walls and the inserts are coated with a moisture barrier on one side to keep moisture from impregnating the cardboard material. The moisture barrier consists of a well-known treatment called Michealman coating or a similar coating. The inserts also have a wax curtain coated strip added to the other side to enhance the moisture resistance around the tube hole. Thus, the moisture from the wreaths will not impregnate the cardboard at that point and make the cardboard so weak that the weight of the tube and supported wreaths will cause it to collapse.

The box and the inserts of the present invention are each made from a one-piece planar blank. The insert blank comprises the base having the tube hole and ventilation holes and also having slots along the top and bottom for latching the four side walls in place. Along the top and bottom of the base are two side members each having a proximal portion and a distal portion. The proximal portion is bendable along a fold line adjacent the base and along an opposing fold line adjacent the distal portion. The distal portion has tabs extending from one edge that fit into the slots of the base when the proximal portion is bent perpendicular to the base and the distal portion is bent down to the base to form a side wall of the insert. Side flaps are adjacent the base along a fold line extending the length of the base. Each side flap has two flap extensions extending beyond the length of the base. The flap extensions are bendable along a fold line and are not attached to the two side members. The side flaps are bent perpendicular to the base and the flap extensions are bent perpendicular to the side flaps to fit between the distal portion and proximal portion of the side members when the proximal portion is bent perpendicular to the base and the distal portion is bent down to fit the tabs into the slots. In this manner, the four side walls of the insert are set up from a one-piece planar blank. The tube hole cut into the base of the insert has radial cuts outward from the center of the hole which allow the tube hole to expand to accept the elongated tube fit slidably through it.

The box is formed from a one-piece planar blank comprising the four sides lying adjacent one another, side by side, separated by three parallel fold lines. Each side has a pair of end flaps. The end flaps are bendable along two parallel fold lines perpendicular to the three parallel fold lines. The end flaps are cut through along the three parallel lines up to the four sides so that when the four sides are bent to form a rectangle, the four pairs of flaps can be bent to form the two ends of the box. A tab extension is adjacent one of the four sides along a fourth fold line parallel to the three fold lines. The tab extension is attached with glue, staples or other means to a second side of the box to hold the box in a rectangle.

The center insert(s) and wreaths are slid onto the elongated tube through the ends of the box. Before the box is closed, the end insert is added. Because the tube is located near the top of the box when the wreaths are slid onto the tube and supported thereby, the wreaths do not become crushed against the bottom of the box. The dimensions of the box are such that the wreaths slide snugly into the box and do not move around during shipment. The length of the box is dimensioned so that the girth plus the length of the longest side is less than 130 inches. This allows the package to be shipped via UPS. Using this dimension, up to ten wreaths per carton can be shipped.

Other objects, features and advantages of the present invention will become apparent to those skilled in the art through the description of the preferred embodiment, claims, and drawings herein.

DESCRIPTION OF THE PREFERRED EMBODIMENT

Figure 1:
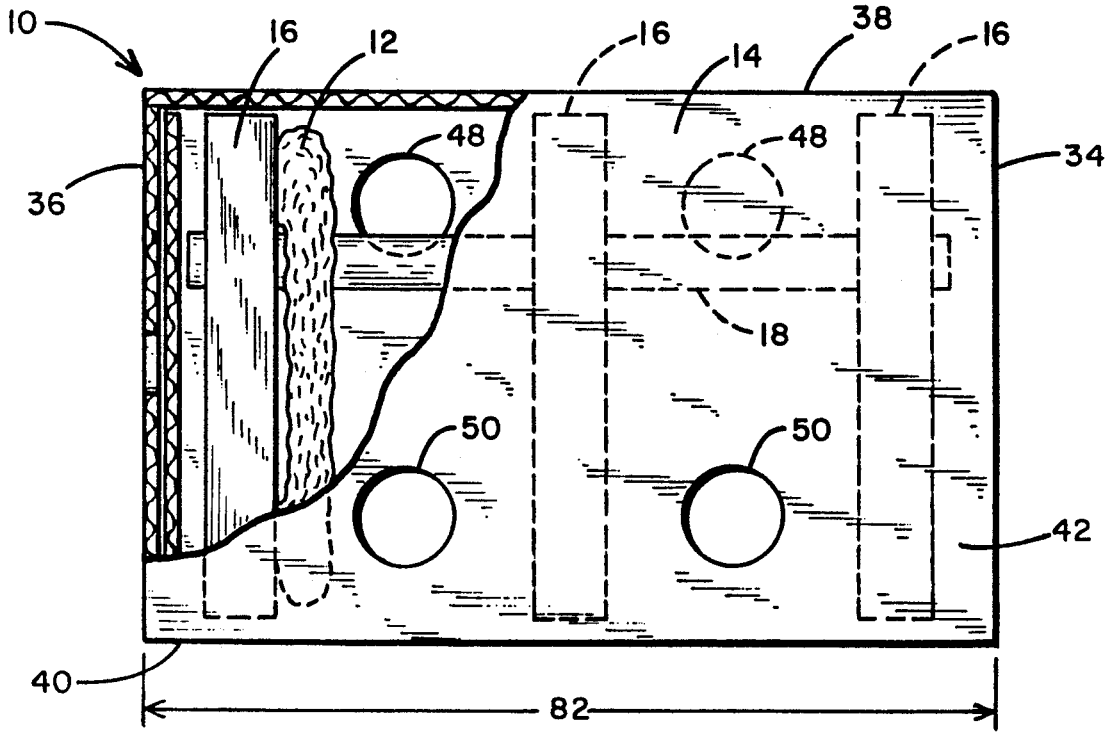
FIG. 1 is a partial cross-sectional view of the side of the container showing inserts, elongated tube, ventilation holes and a wreath in plain view as drawn with solid lines or in hidden view as drawn with dashed lines.

Indicated generally in FIG. 1 is a shipping container 10 designed for storing and shipping decorative wreaths 12. The shipping container 10 comprises a box 14 having six sides, three identical inserts 16 and an elongated tube 18 on which the wreaths 12 are suspended.

Figure 2:
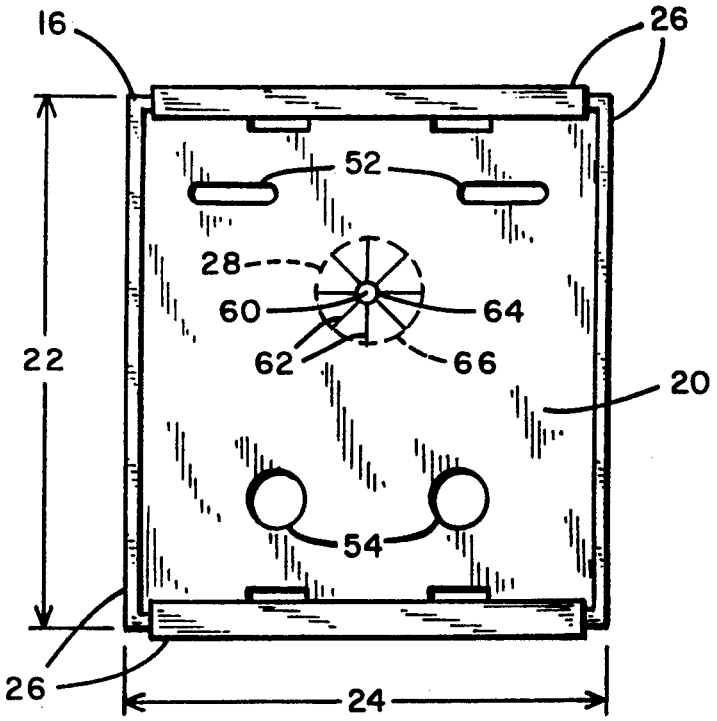
FIG. 2 is a front perspective view of an insert showing the four side walls, ventilation holes and tube hole.
Figure 3:
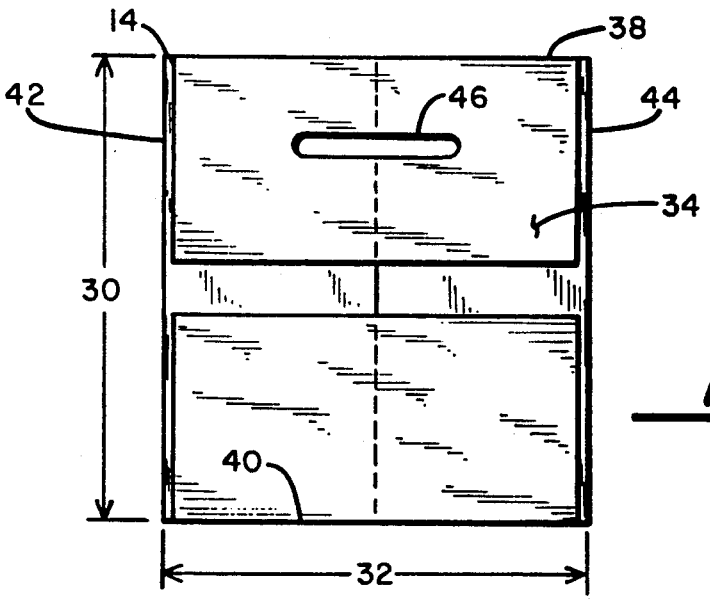
FIG. 3 is an end perspective view of the box when the end flaps are closed.

As shown in FIG. 2, the inserts 16 each comprise a planar base 20 having a length dimension 22 and a width dimension 24, four side walls 26 and a tube hole 28 through which the elongated tube 18 passes. The length 22 and width 24 of the base 20 are slightly smaller than the length 30 and width 32 of the box 14 (FIG. 3). This allows the inserts 16 to be slidably inserted into the box 14 parallel to the plane of the ends 34 and 36 of the box 14.

The elongated tube 18 extends through the tube holes 28 of the inserts 16 perpendicular to the planes of the bases 20. A plurality of wreaths 12 hang on the elongated tube 18 supported by the inserts 16. The inserts 16 assist in maintaining the structural integrity of the box 14 when objects are stacked on the box 14. In general, the box 14, the inserts 16 and the elongated tube 18 are made out of corrugated cardboard. The shipping container 10 prevents the wreaths 12 from being crushed by either their own weight or the weight of objects stacked on the box 14. The shipping container 10, as described below, also alleviates the problem of wreaths 12 becoming moldy or rotten.

As shown in FIGS. 1 and 3, the box 14 has six sides; two ends 34 and 36, a top 38, a bottom 40 and two opposing sides 42 and 44. Each end 34 and 36 has a hand hole 46 in the top half for ventilation and for carrying the container 10. The hand holes 46 are large enough for a person to comfortably slide four fingers into but small enough to assure that the box maintains its strength. The two opposing sides 42 and 44, extending from the top 38 to the bottom 40 of the box 14 between the two ends 34 and 36, have ventilation holes in them. One opposing side 44 has ventilation holes 48 in the top half and the other opposing side 42 has ventilation holes 50 in the bottom half. The ventilation holes 48 and 50 in the opposing sides 44 and 42, respectively, allow air to flow through the wreaths 12. The air flow through the wreaths 12 carries out moisture given off by the wreaths 12 preventing the moisture from condensing and creating a condition conducive to growing mold or rotting the wreaths 12. To allow air to flow from one end 34 of the box 14 to the other end 36 or vice versa, each insert 16 (FIG. 2) has two oblong shaped insert ventilation holes 52 in the top half of the base 20 and two circular shaped ventilation holes 54 in the bottom half of the base 20.

The hand holes 46 in the ends of the box 14 and the ventilation holes 52 and 54 in the base 20 of the inserts 16 allow air to flow from one end of the shipping container 10 to the other. As mentioned, this air flow helps to alleviate the moisture problem.

To prevent moisture from impregnating the cardboard of the box 14 and the inserts 16, both the box 14 and the inserts 16 are coated with a moisture barrier. The box 14 is coated on the inside with the well-known Michealman coating or a similar coating and the inserts 16 are coated on one side with Michealman coating and on the other side with a wax curtain coat. The wax curtain coat extends along a strip 67 (FIG. 5) the length of the insert 16 around the tube hole 28. The Michealman coating retards the absorption of moisture by the cardboard and the curtain coating prevents moisture from impregnating and weakening the cardboard. Thus, the cardboard is strengthened by the moisture barriers.

The tube hole 28 of the insert 16 is located in the top half of the base 16 so the elongated tube 18 is supported far enough from the bottom of the box 14 to prevent the wreaths 12 from resting on the bottom and being crushed by their own weight. The tube hole 28 is a small circular aperture 60 having radial cuts 62 extending from an inner radius 64 to an outer radius 66. The radial cuts 62 allow the aperture 60 to expand to fit around the elongated tube 18.

Figure 4:
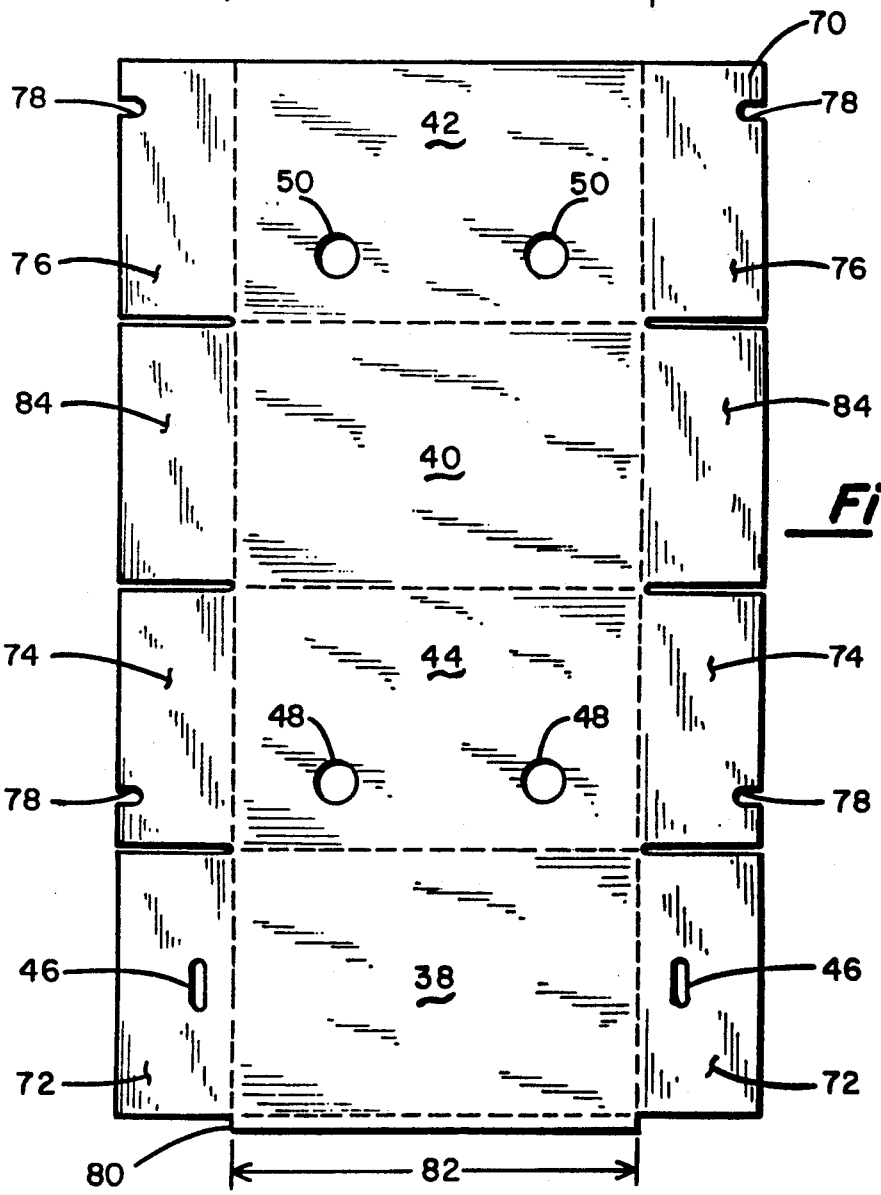
FIG. 4 is a plan view of a planar box blank ready to be set up to form the box for the container.

The two ends 34 and 36, the top 38, the bottom 40 and the two opposing sides 42 and 44 of the box 14 are set up from a one piece planar box blank 70, shown in FIG. 4. The box blank top 38 has two adjacent end flaps 72 along two parallel fold lines, indicated by dashed lines in FIG. 4. Each end flap 72 of the top 38 has a hand hole 46. The opposing sides 44 and 42 have circular box ventilation holes 48 and 50 in either the top half or the bottom half, respectively. Each opposing side also has a pair of end flaps 74 and 76 attached to it. The end flaps 74 and 76 of the opposing sides 44 and 42 each have semi-oblong cut-outs 78 that align with the hand holes 46 in the end flaps 72 when folded over. The top 38 has a tab extension 80 extending along the depth 82 of the box 14. The tab extension 80 is bendable along a fold line adjacent the top 38 so the tab extension 80 can be connected to the opposing side 42 when the box is formed from the planar box blank 70.

To form the box 14 from the planar box blank 70, the top 38 is bent perpendicular to one opposing side 44. The opposing side 44 is then bent perpendicular to the bottom 40 so that the bottom 40 and the top 38 are parallel to and facing one another. The second opposing side 42 is next bent perpendicular to the bottom 40 so opposing sides 44 and 42 are parallel to and facing one another. The tab extension 80 is bent perpendicular to the top 38 to fit underneath the opposing side 42 to which it is connected with glue, staples or other similar means. After the inserts 16, elongated tube 18 and wreaths 12 have been slid into the box 14, the bottom end flaps 84 are bent perpendicular to the bottom toward the top 38, the opposing side end flaps 74 and 76 are bent toward one another perpendicular to the opposing sides 44 and 42, and the top end flaps 72 are bent perpendicular to the top 38 toward the bottom 40. The end flaps are stapled, glued or otherwise connected to form the two ends 34 and 36 of the box 14. The length 30 and width 32 of the box 14 are dimensioned so that the wreaths 12 and inserts 16 can easily slide onto the elongated tube 18 and snugly fit inside the box 14.

Figure 5:
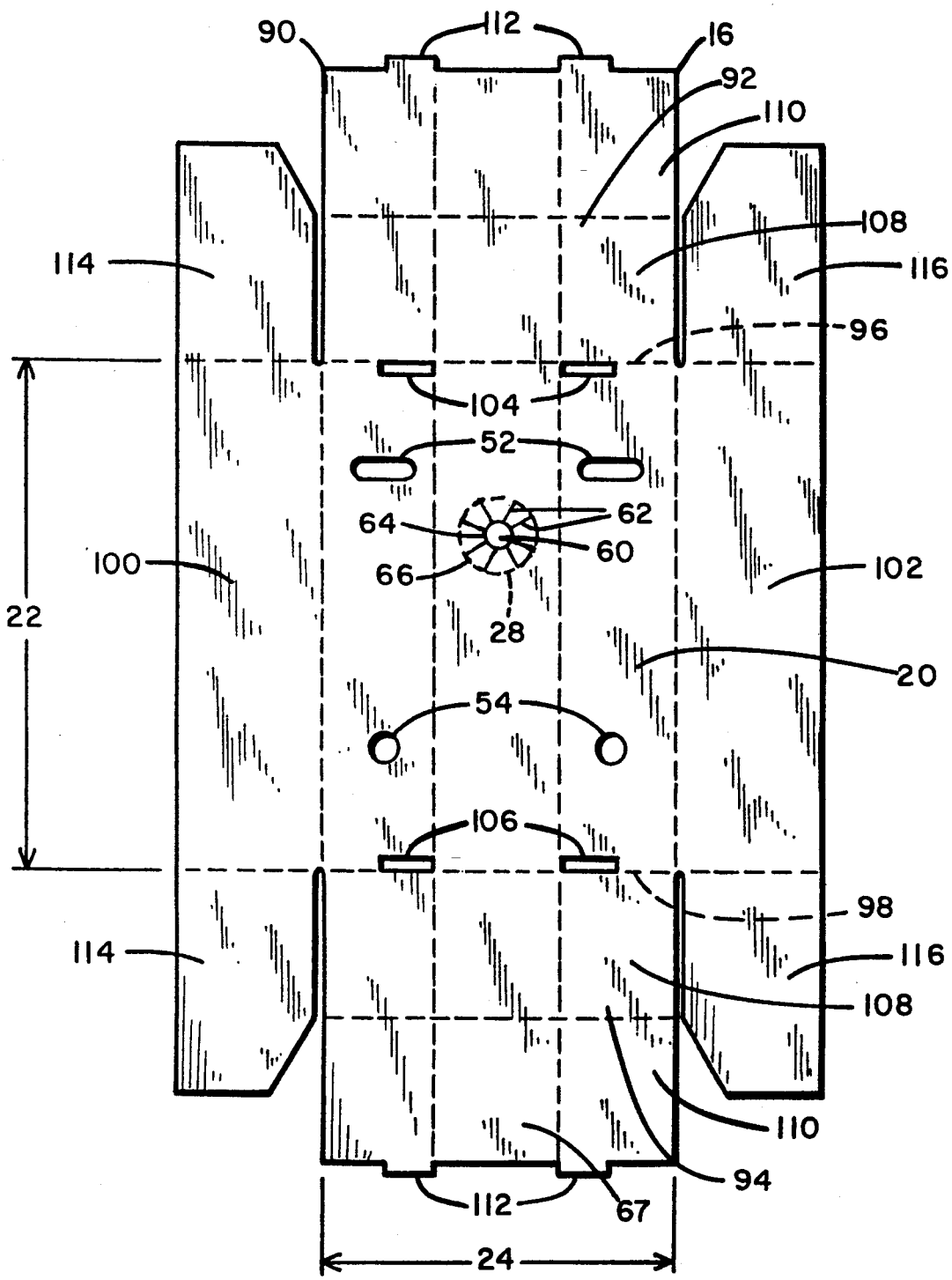
FIG. 5 is a plan view of a planar insert blank ready to be set up to form an insert for the container.

The inserts 16 are set up from a one piece planar insert blank 90, shown in FIG. 5. The planar insert blank 90 comprises the base 20 having two side members 92 and 94 extending from the top 96 and bottom 98 of the base 20 along fold lines, shown as dashed lines in FIG. 5, and two side flaps 100 and 102 extending along the length 22 of the base 20 along fold lines. The base 20 has a tube hole 28 which has a circular aperture 60 in the middle and equilinear radial cuts 62 extending from the small aperture radius 64 to a larger outer radius 66. This configuration allows the tube hole 28 to expand and accept the elongated tube 18. The tube hole 28 is in the upper half of the base 20 toward the top 96. Above the tube hole 28 equally spaced on each side are two oblong shaped insert ventilation holes 52. Below the tube hole 28 in the lower half of the base 20 are two circular insert ventilation holes 54 equally spaced on each side of the tube hole 28.

Along the top 96 of the base 20 are two rectangular slots 104 used for latching the side walls 26 of the insert 16 to the base 20 in a manner to be described. At the bottom 98 of the base 20 are two more rectangular slots 106 identical to the rectangular slots 104 at the top 96 and used for latching the side walls 26 to the base 20. The two side members 92 and 94 extending from the top 96 and the bottom 98 of the base 20 each have a proximal portion 108 and a distal portion 110. The proximal portion 108 is adjacent the base 20 along a fold line and adjacent the distal portion 110 along another fold line. The distal portion has two tabs 112 extending therefrom. The tabs 112 are dimensioned to fit into the slots 104 and 106. Each of the side flaps 100 and 102 have a pair of flap extensions 114 and 116 extending beyond the length 22 of the base 20 adjacent the side flaps 100 and 102 along fold lines. The flap extensions 114 and 116 are not connected to the two side members 92 and 94. Thus, when the side flaps 100 and 102 are bent perpendicular to the base 20, the side flap extensions 114 and 116 can be bent perpendicular to the side flaps 100 and 102 and extend along the top 96 and bottom 98 of the base 20. The proximal portions 108 of the two side members 92 and 94 are bent perpendicular to the base 20 outside the side flap extensions 114 and 116. The distal portions 110 of the two side members 92 and 94 are bent toward the base 20, around the side flap extensions 114 and 116 and the tabs 112 are fit into the rectangular slots 104 and 106 in the base 20. This forms the four side walls 26 of the insert 16 perpendicular to the base 20 of the insert 16.

The insert 16 whose length 22 and width 24 are slightly smaller than the length 30 and width 32 of the box 14 is slidably inserted into the box 14 with the base 20 parallel to the two ends 34 and 36 and perpendicular to the top 38, bottom 40 and two opposing sides 42 and 44. Wreaths 12 are inserted into the box 14 on both sides of the middle insert 16. An insert 16 is snugly fit inside each end of the box 14 and the ends 34 and 36 are closed.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed is:

1. A container comprising:

(a) a carton having four sides and two opposed ends;

(b) at least one insert having a base with a tube hole formed therethrough, the insert fitting inside the carton; and (c) an elongated tube extending through the tube hole from one end of the carton to the other end of the carton.

2. The container of claim 1, wherein at least two of the four sides of said carton have vent holes.

3. The container of claim 2, wherein the base of said insert has holes for ventilation.

4. The container of claim 3, wherein said holes for ventilation are located in said base above and below said tube hole.

5. The container of claim 2 wherein the opposed ends of said carton include a hand hole for ventilation and carrying the container.

6. The container of claim 2, wherein said vent holes on one side are disposed above said tube and on the other side are below said tube.

7. The container of claim 1, wherein said carton ends have a hand hole for ventilation and carrying the container and at least two of the other four sides have holes for ventilation.

8. The container of claim 7, wherein said base of said insert has holes for ventilation.

9. The container of claim 8, wherein said holes for ventilation in said base are disposed both above and below said tube hole.

10. The container of claim 1, wherein the carton is formed from a one-piece planar box blank, the planar box blank comprising:

(a) four sides adjacent to one another along three parallel fold lines;

(b) four pairs of end flaps adjacent to the four sides, one pair to a side, along two fold lines perpendicular to the three parallel fold lines, the end flaps cut along the three parallel fold lines to the four sides so that when the four sides are bent at 90° along said three parallel fold lines, the four pairs of end flaps can be bent to form two end panels; and (c) a tab extension adjacent one of the four sides along a further fold line parallel to said three parallel fold lines for attaching one side to another side.

11. The container of claim 10, wherein the box is made of cardboard and further comprising a moisture barrier means on one side of the planar box blank.

12. The container of claim 11, wherein the moisture barrier means is Michealman coating.

13. The container of claim 1, wherein the carton is made of cardboard and further comprising a moisture barrier means on the inside of the carton.

14. The container of claim 13, wherein the moisture barrier means is Michealman coating.

15. The container of claim 1, wherein the insert is made of cardboard and further comprising a moisture barrier means on one side.

16. The container of claim 15, wherein the moisture barrier means is Michealman coating.

17. The container of claim 1, wherein the insert is cardboard and has a wax curtain coating around the tube hole.

18. The container of claim 1, wherein the insert is set up from a one piece planar insert blank, the planar insert blank comprising:

(a) the base having the tube hole and also having slots for latching the side walls in place;

(b) a side member having a proximal portion and a distal portion, the proximal portion adjacent the base along a fold line and adjacent the distal portion along a parallel fold line, the distal portion having tabs that fit into the slots when the distal portion and proximal portion are bent to form the side walls; and (c) a side flap adjacent the base having a flap extension beyond the base, the flap extension bendable along a fold line so that the flap extension can be inserted between the distal and proximal portions of the side member when the side flap and the proximal and distal portions are bent to fit the tabs into the slots to form the side walls.

19. A container comprising:

(a) two ends and four sides therebetween;

(b) an insert having a base and side walls, the base having a tube hole; and (c) an elongated tube extending through the tube hole for supporting an article being transported or stored, the tube extending perpendicular to a plane of the base and generally from one end to another.

20. A container for decorative wreaths comprising:

(a) a box having four sides and two ends;

(b) a plurality of inserts each having a base and four mutually perpendicular side walls fitted into the box for support, each base having a tube hole formed therethrough; and (c) an elongated tube extending through said tube holes in said plurality of inserts for holding at least one toroidal wreath, the tube extending perpendicular to the planes of the bases of said plurality of inserts through said tube holes and the center opening of said toroidal wreath and generally from one end of said box to the other end such that said wreath remains out of contact with respect to one of said sides.

21. The container of claim 20 wherein at least some of said sides and said bases of said plurality of inserts includes vent holes for exhausting moisture given off from said wreaths.

* * * * *